US011605329B2

(12) United States Patent
Chang

(10) Patent No.: US 11,605,329 B2
(45) Date of Patent: Mar. 14, 2023

(54) DISPLAY APPARATUS

(71) Applicant: E Ink Holdings Inc., Hsinchu (TW)

(72) Inventor: Chien-Hsing Chang, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/371,099

(22) Filed: Jul. 8, 2021

(65) Prior Publication Data

US 2022/0122508 A1 Apr. 21, 2022

(30) Foreign Application Priority Data

Oct. 15, 2020 (TW) ..... 109135648

(51) Int. Cl.
*G09G 3/20* (2006.01)

(52) U.S. Cl.
CPC ..... *G09G 3/20* (2013.01); *G09G 2300/04* (2013.01)

(58) Field of Classification Search
CPC ..... G09G 3/20; G09G 2300/04
See application file for complete search history.

(56) References Cited

U.S. PATENT DOCUMENTS 5,847,780 A 12/1998 Kim et al.
6,788,278 B2 9/2004 Aoki
8,796,913 B2 8/2014 Furusawa et al.
2007/0120805 A1* 5/2007 Yi ..... G09G 3/3696 345/100
2007/0285370 A1 12/2007 Kim
2011/0050749 A1* 3/2011 Park ..... G09G 3/3291 345/76
2011/0080388 A1* 4/2011 Lo ..... G09G 3/20 345/55
2015/0186098 A1* 7/2015 Hall ..... G09G 3/2096 345/1.3
2015/0310824 A1* 10/2015 Yang ..... G09G 3/20 345/213
2016/0155408 A1* 6/2016 Lee ..... G09G 3/20 345/211
2016/0155423 A1* 6/2016 Shin ..... G09G 5/18 345/520
2019/0051670 A1* 2/2019 Bei ..... H01L 27/3276
2020/0074947 A1* 3/2020 Seo ..... G09G 3/3225

FOREIGN PATENT DOCUMENTS

TW I706402 10/2020

OTHER PUBLICATIONS

"Office Action of Taiwan Counterpart Application", dated Jul. 14, 2021, p. 1-p. 6.

* cited by examiner

*Primary Examiner* — Sejoon Ahn
(74) *Attorney, Agent, or Firm* — JCIPRNET

(57) ABSTRACT

A display apparatus, including a display panel and a first driver, is provided. The display panel includes multiple pixel circuits and multiple first wires. The first wires are configured to transmit multiple first driving signals. Each of the first wires includes a first portion and a second portion. The first driving signal is transmitted in the first portion and the second portion in different directions. The first driver is coupled to the display panel. The first driver is configured to output the driving signals to drive the display panel.

11 Claims, 7 Drawing Sheets

DISPLAY APPARATUS

CROSS-REFERENCE TO RELATED APPLICATION

This application claims the priority benefit of Taiwan application serial no. 109135648, filed on Oct. 15, 2020. The entirety of the above-mentioned patent application is hereby incorporated by reference herein and made a part of this specification.

BACKGROUND

Technical Field

This disclosure relates to a display apparatus, and in particular to a display apparatus with a low magnetic field strength.

Description of Related Art

A drive line on a display panel (for example, a scan drive line, or a data drive line, etc.) generate a magnetic field due to a change in current, which will interfere with other electronic components. For example, when applied with an electromagnetic board, since the electromagnetic board generates a detection signal through induction of a magnetic field, under influence by an external magnetic field, the electromagnetic detection result is easily interfered by a magnetic field generated by a display driver, therefore easily causing an error in the detection by the electromagnetic board.

To address the above issue, the related art adds a shielding layer (commonly designed as a metal grid) between the electromagnetic board and the display to reduce the magnetic field induction of the two. However, attaching a metal material externally increases the overall cost and complicates the production process. Another solution is to adjust a driver frequency of the display. However, adjusting the driver frequency will increase the difficulty in designing the display driver control and manufacturing the display panel, severely reducing production yield, which is unfavorable for cost reduction and control.

SUMMARY

The disclosure provides a display apparatus with a low magnetic field strength, which can prevent interference with other electronic components.

The display apparatus of the disclosure includes a display panel and a first driver. The display panel includes multiple pixel circuits and multiple first wires. The first wires are configured to transmit multiple first driving signals. Each of the first wires includes a first portion and a second portion. The first driving signal is transmitted in the first portion and the second portion in different directions. The first driver is coupled to the display panel. The first driver is configured to output the first driving signals to drive the display panel.

In an embodiment of the disclosure, the first portion and the second portion are located on the same layer.

In an embodiment of the disclosure, the first portion and the second portion are respectively located on two layers that are one on top of the other.

In an embodiment of the disclosure, a line formed by the first portion and the second portion is a twisted pair.

In an embodiment of the disclosure, the first wires are data lines, and the first driving signal is a data signal.

In an embodiment of the disclosure, the first wires are scan lines, and the first driving signal is a scan signal.

In an embodiment of the disclosure, the display apparatus further includes a second driver. The second driver is coupled to the display panel. The second driver is configured to output multiple second driving signals to drive the display panel. The display panel further includes multiple second wires. The second wires are configured to transmit the second driving signals. Each of the second wires includes a third portion and a fourth portion. The second driving signal is transmitted in the third portion and the fourth portion in different directions.

In an embodiment of the disclosure, the third portion and the fourth portion are located on the same layer.

In an embodiment of the disclosure, the third portion and the fourth portion are respectively located on two layers that are one on top of the other.

In an embodiment of the disclosure, a line formed by the third portion and the fourth portion is a twisted pair.

In an embodiment of the disclosure, the first portion and the second portion are substantially parallel.

Based on the above, in the embodiment of the disclosure, the driving signal is transmitted in different directions on the wires of the display apparatus, which can reduce the magnetic field strength of the display apparatus.

To make the above features and advantages more comprehensible, several embodiments accompanied by drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
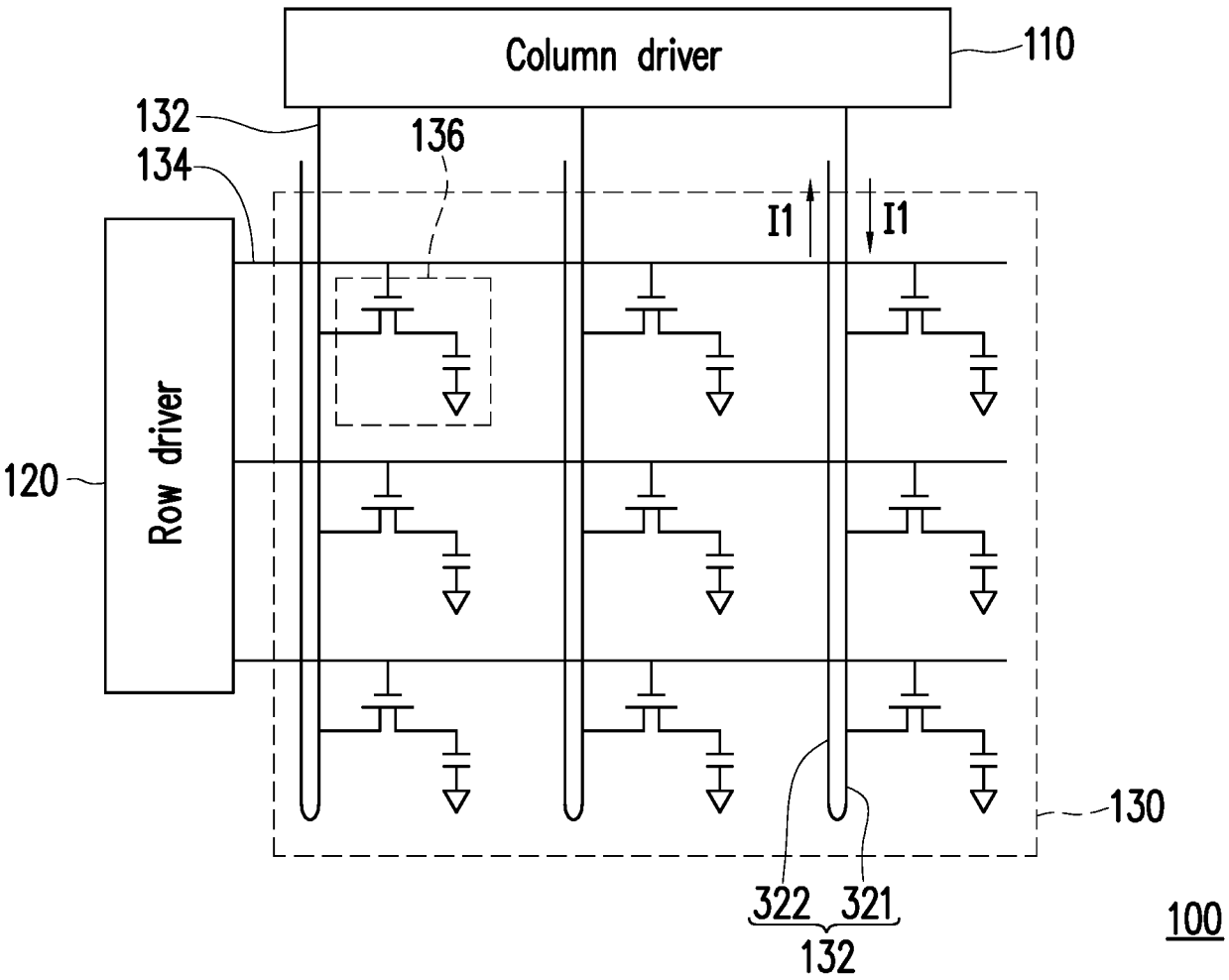
FIG. 1 is a schematic diagram of a display apparatus according to an embodiment of the disclosure.

FIG. 1 is a schematic diagram of a display apparatus according to an embodiment of the disclosure. With reference to FIG. 1, a display apparatus 100 of this embodiment includes a column driver 110 (first driver), a row driver 120 and a display panel 130. The column driver 110 and the row driver 120 are respectively coupled to the display panel 130 through data lines 132 (first wires) and scan lines 134. The display panel 130 includes multiple pixel circuits 136 arranged in an array.

The row driver 120 outputs a scan signal to a pixel row to drive the display panel 130 and switch on a transistor in the pixel circuit 136. The scan lines 134 are configured to transmit the scan signal. The column driver 110 outputs a data signal I1 (first driving signal) to the pixel circuit 136 to drive pixels on the display panel 130 to display images. The data lines 132 are configured to transmit the data signal I1.

In the embodiment, the data line 132 includes a first portion 321 and a second portion 322. The first portion 321 and the second portion 322 may be regarded as two substantially parallel wires located on the same layer. The data signal I1 is transmitted in different directions in the first portion 321 and the second portion 322. A trace manner of the data line 132 is designed from a single trace to a double trace. A loop is designed at an end of the first portion 321 to direct the data signal I1 from the first portion 321 to the second portion 322. Since currents of the data signal I1 have the same magnitude but are in opposite directions, magnetic fields generated by the data signal I1 on the data line 132 may cancel each other. Therefore, the display apparatus has a characteristic of low magnetic field strength, which can prevent interference with other electronic components. In addition, in the embodiment, the first portion 321 and the second portion 322 of the data line 132 are two substantially parallel wires in the same layer. The shorter a distance between the two, the greater the reduction in the magnetic fields.

Figure 2:
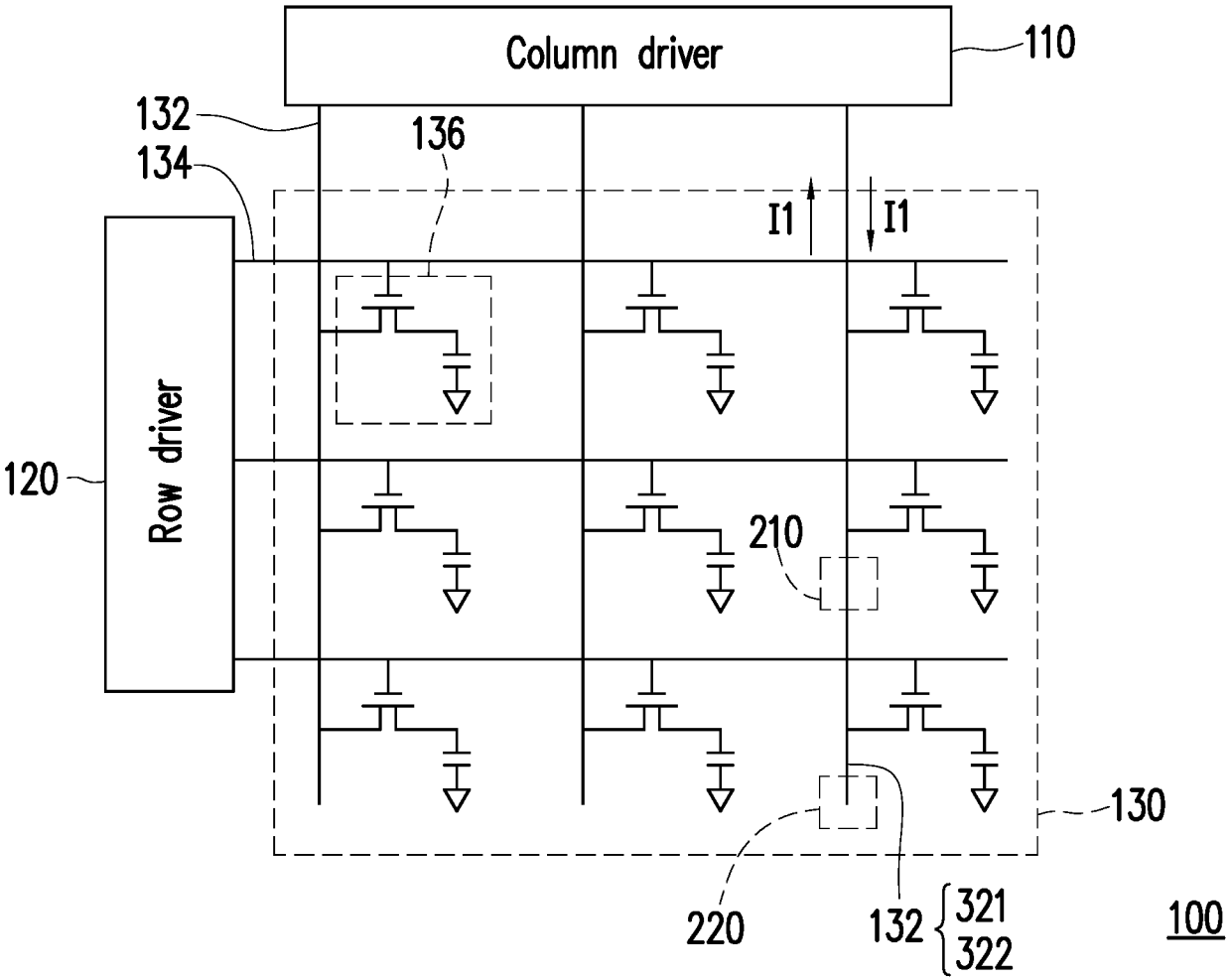
FIG. 2 is a schematic diagram of a display apparatus according to another embodiment of the disclosure.
Figure 3B:
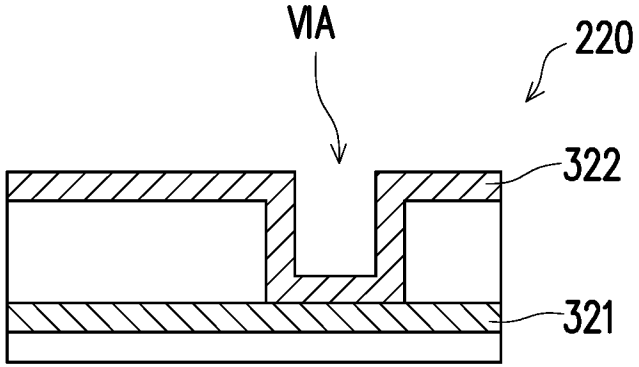
FIGS. 3A and 3B are schematic diagrams of a wire structure at different positions in the embodiment of FIG. 2.
Figure 3A:
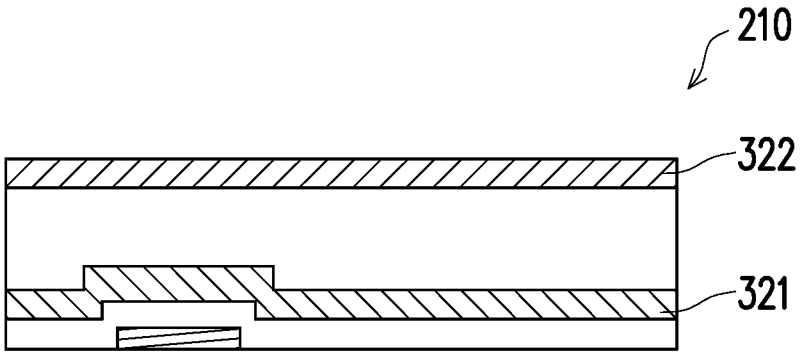

FIG. 2 is a schematic diagram of a display apparatus according to another embodiment of the disclosure. FIGS. 3A and 3B are schematic diagrams of a wire structure at different positions in the embodiment of FIG. 2. With reference to FIGS. 1 to 3B, in the embodiment of FIG. 1, the first portion 321 and the second portion 322 of the data line 132 are located on the same layer, but the disclosure is not limited thereto. The first portion 321 and the second portion 322 of the data line 132 may also be respectively located on two layers that are one on top of the other in the wire structure.

FIG. 3A is a schematic structural diagram of an intermediate structure 210 of the data line 132. In FIG. 3A, it is shown that the first portion 321 and the second portion 322 of the data line 132 are respectively located on the two layers that are one on top of the other of the wire structure. A layer between the two layers that are one on top of the other is a non-conductive layer. FIG. 3B shows a schematic diagram of an end structure 220 of the data line 132. In FIG. 3B, it is shown that the first portion 321 and the second portion 322 are electrically connected through a via VIA.

Since the currents of the data signal I1 have the same magnitude but are in opposite directions, the magnetic fields generated by the data signal I1 on the data line 132 may cancel each other. Therefore, the display apparatus has the characteristic of low magnetic field strength, which can prevent interference with other electronic components. In addition, in the embodiment, the first portion 321 and the second portion 322 of the data line 132 are two parallel wires in a vertical direction. The shorter the distance between the two, the greater the reduction in the magnetic fields.

Figure 4:
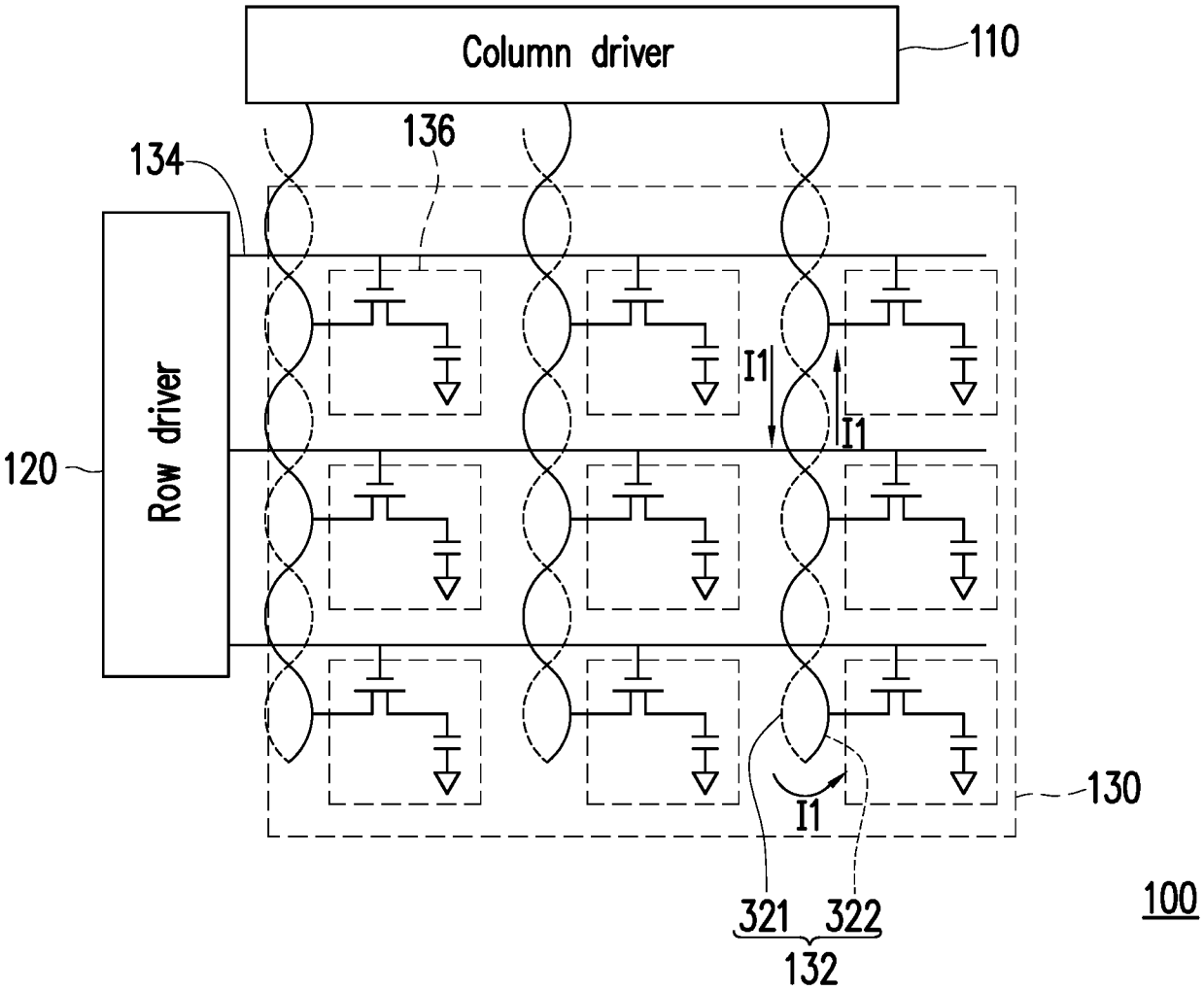
FIG. 4 is a schematic diagram of a display apparatus according to yet another embodiment of the disclosure.
Figure 5:
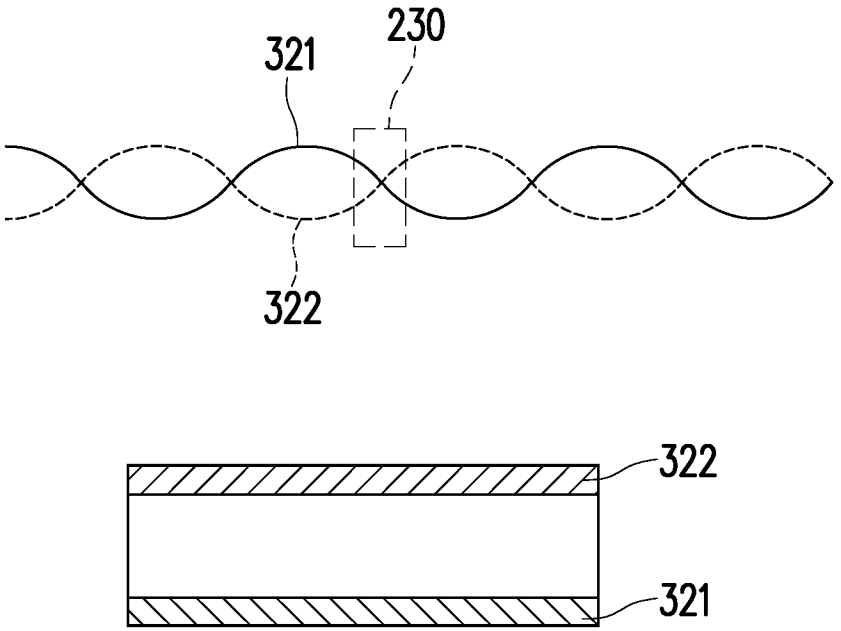
FIG. 5 is a schematic diagram of a node structure of the embodiment in FIG. 4.

FIG. 4 is a schematic diagram of a display apparatus according to yet another embodiment of the disclosure. FIG. 5 is a schematic diagram of a node structure of the embodiment in FIG. 4. With reference to FIGS. 4 and 5, in the embodiment, a line formed by the first portion 321 and the second portion 322 of the data line 132 is a twisted pair. The first portion 321 and the second portion 322 are not conductive at a node 230 of the twisted pair. In FIG. 5, it is shown that the first portion 321 and the second portion 322 of the data line 132 are respectively located on two layers that are one on top of the other in the node 230. There is a non-conductive layer between the two layers that are one on top of the other, so that the first portion 321 and the second portion 322 are not conductive at the node 230 of the twisted pair.

Since the currents of the data signal I1 have the same magnitude but are in opposite directions, the magnetic fields generated by the data signal I1 on the data line 132 may cancel each other. Therefore, the display apparatus has the characteristic of low magnetic field strength, which can prevent interference with other electronic components. In addition, in the embodiment, the line formed by the first portion 321 and the second portion 322 of the data line 132 is a twisted pair, and the shorter a distance between the nodes 230, the greater the reduction in the magnetic fields.

Figure 6:
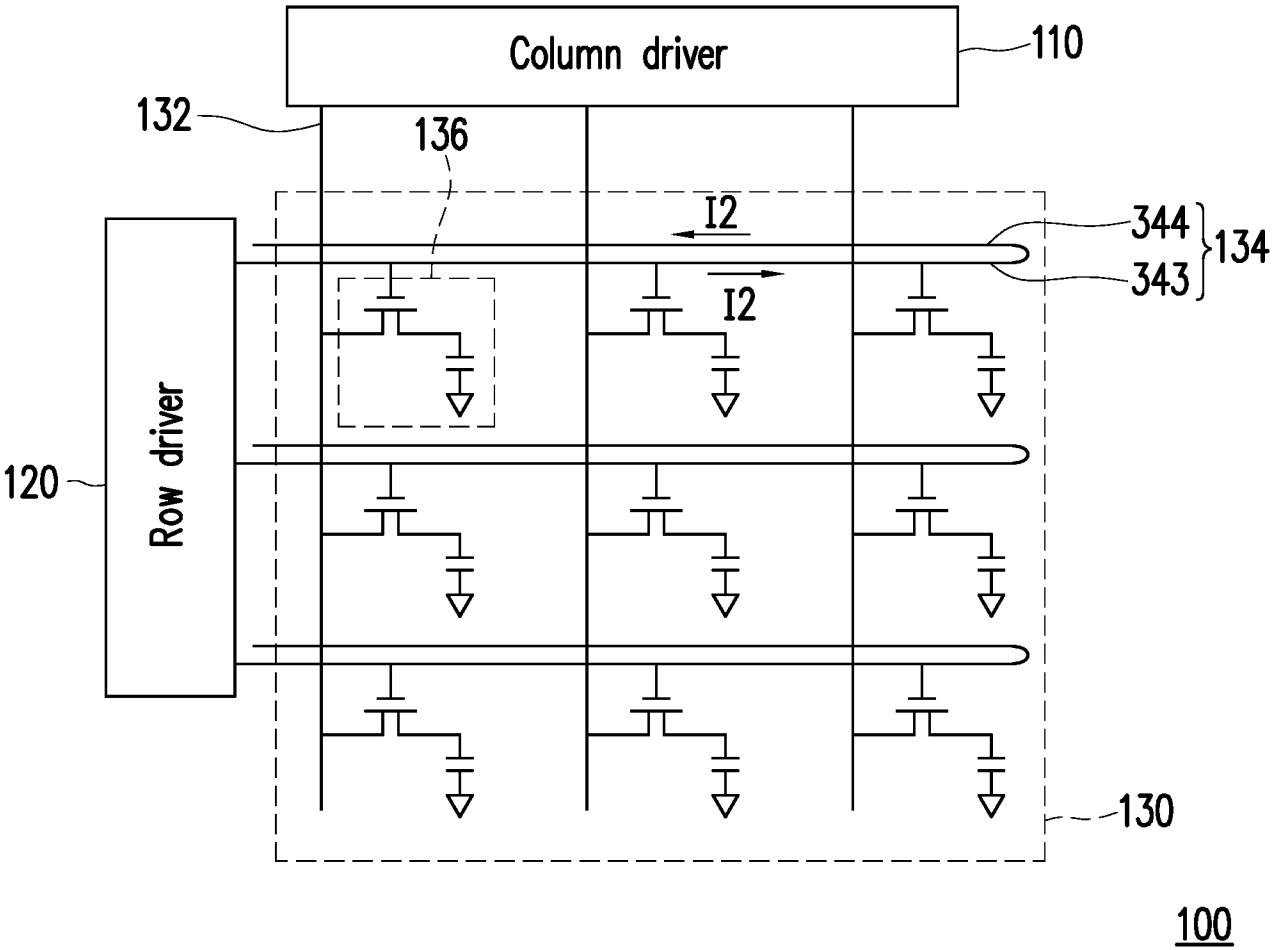
FIG. 6 is a schematic diagram of a display apparatus according to still another embodiment of the disclosure.

FIG. 6 is a schematic diagram of a display apparatus according to still another embodiment of the disclosure. With reference to FIGS. 1 and 6, in the embodiment of FIG. 1, the trace manner of the data line 132 of the display apparatus 100 is designed from a single trace to a double trace to reduce the magnetic fields generated by the data signal I1 on the data line 132, but the disclosure is not limited thereto. In the embodiment of FIG. 6, a trace manner of the scan line 134 (first wire) of the display apparatus 100 is designed from a single trace to a double trace to reduce magnetic fields generated by a scan signal I2 (first driving signal) on the scan line 134.

Figure 7:
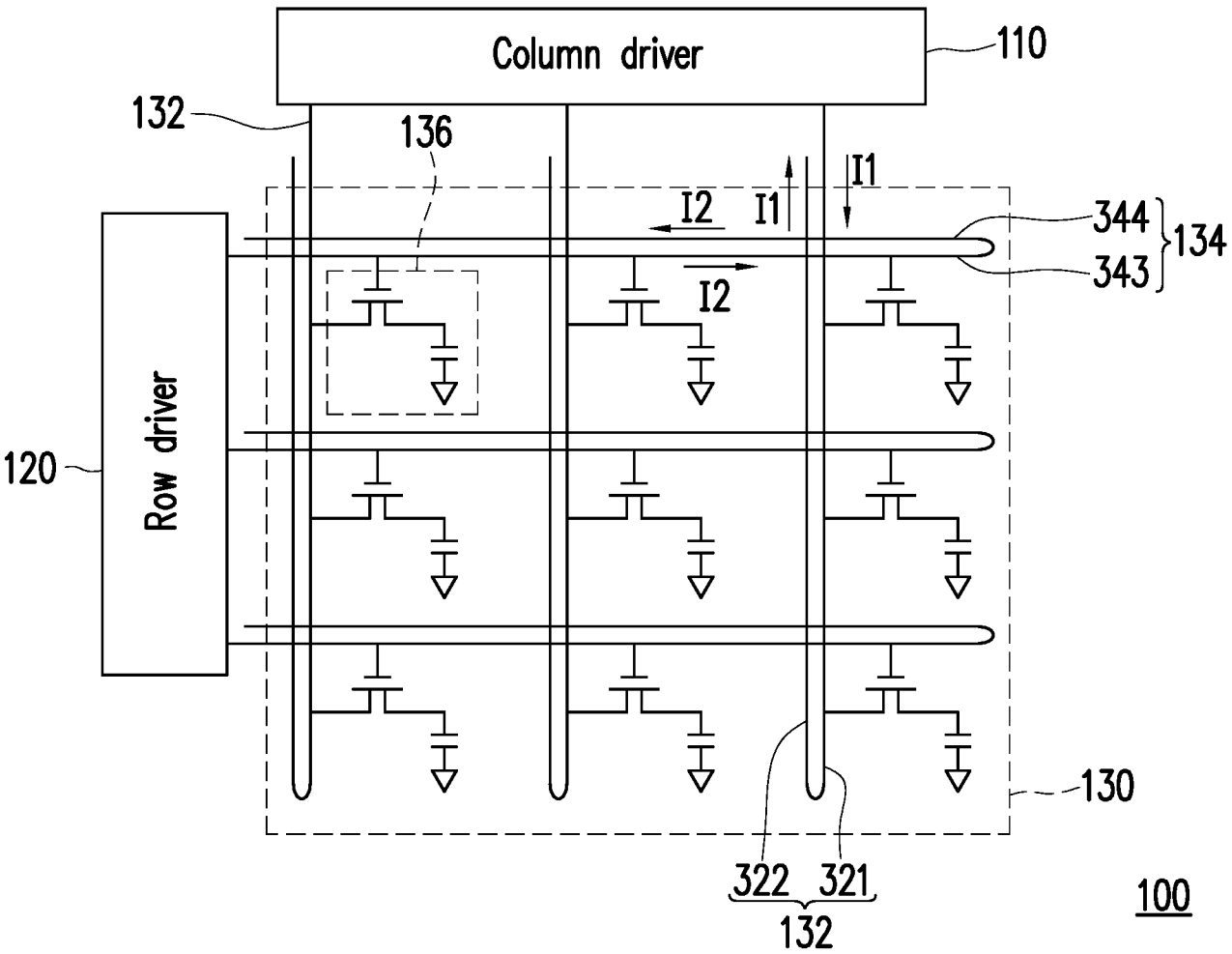
FIG. 7 is a schematic diagram of a display apparatus according to still yet another embodiment of the disclosure.

FIG. 7 is a schematic diagram of a display apparatus according to still yet another embodiment of the disclosure. With reference to FIGS. 1, 6 and 7, in the embodiments of FIGS. 1 and 6, the trace manners of the data line 132 and the scan line 134 of the display apparatus 100 are respectively designed from the single trace to the double trace to respectively reduce the magnetic fields generated by the data signal I1 on the data line 132 and the scan signal I2 on the scan line 134, but the disclosure is not limited thereto.

In the embodiment of FIG. 7, the data line 132 (first wire) includes the first portion 321 and the second portion 322. A loop is designed at the end of the first portion 321 to direct the data signal I1 (first driving signal) outputted by the column driver 110 (first driver) from the first portion 321 to the second portion 322. On the other hand, the scan line 134 (second wire) includes a third portion 343 and a fourth portion 344. A loop is designed at an end of the third portion 343 to direct the scan signal I2 (second driving signal) outputted by the row driver 120 (second driver) from the third port 343 to the fourth port 344.

That is to say, in the embodiment, the data line 132 and the scan line 134 of the display apparatus 100 are simultaneously designed from the single trace to the double trace to reduce the magnetic fields respectively generated by the data signal I1 on the data line 132 and the scan signal I2 on the scan line 134.

In summary, in the embodiments of the disclosure, by utilizing the design of the trace manner of the wires in the display panel from a single trace to a double trace, the magnetic field strength of the display apparatus is reduced. This wire may be a data line and/or a scan line. It utilizes an end of the original wire to design a loop to direct the current of the wire to an adjacent portion, forming a structure similar to two wires. Since the currents of the two wires have the same magnitude and are in opposite directions, the magnetic fields generated by the currents may cancel each other, which can minimize the intensity of the magnetic fields generated by the transmission of the currents during the driving of the display panel. This double trace may be two parallel wires or the twisted pair structure. If it is the parallel wires, the shorter the distance between the wires, the greater the effect of reducing the magnetic fields. If it is the twisted pair structure, the shorter the distance between the nodes, the greater the effect of reducing the magnetic fields.

Although the disclosure has been described with reference to the above-mentioned embodiments, they are not intended to limit the disclosure. It is apparent that any one of ordinary skill in the art may make changes and modifications to the described embodiments without departing from the spirit and the scope of the disclosure. Accordingly, the scope of the disclosure is defined by the claims appended hereto and their equivalents in which all terms are meant in their broadest reasonable sense unless otherwise indicated.

What is claimed is:

1. A display apparatus, comprising:

a display panel, comprising a plurality of pixel circuits and a plurality of first wires, wherein the plurality of first wires are configured to transmit a plurality of first driving signals, each of the plurality of first wires comprises a first portion and a second portion; and a first driver, coupled to the display panel, and the first driver is configured to output the plurality of first driving signals to drive the display panel, wherein the first driving signal is transmitted in the first portion and the second portion in opposite directions between the first driver and the plurality of pixel circuits.

2. The display apparatus according to claim 1, wherein the first portion and the second portion are located on the same layer.

3. The display apparatus according to claim 1, wherein the first portion and the second portion are respectively located on two layers that are one on top of the other.

4. The display apparatus according to claim 1, wherein a line formed by the first portion and the second portion is a twisted pair.

5. The display apparatus according to claim 1, wherein the plurality of first wires are data lines, and the first driving signal is a data signal.

6. The display apparatus according to claim 1, wherein the plurality of first wires are scan lines, and the first driving signal is a scan signal.

7. The display apparatus according to claim 1, further comprising:

a second driver, coupled to the display panel, and the second driver is configured to output a plurality of second driving signals to drive the display panel, wherein the display panel further comprises a plurality of second wires, configured to transmit the plurality of second driving signals, wherein each of the plurality of second wires comprises a third portion and a fourth portion, and the second driving signal is transmitted in the third portion and the fourth portion in different directions.

8. The display apparatus according to claim 7, wherein the third portion and the fourth portion are located on the same layer.

9. The display apparatus according to claim 7, wherein the third portion and the fourth portion are respectively located on two layers that are one on top of the other.

10. The display apparatus according to claim 7, wherein a line formed by the third portion and the fourth portion is a twisted pair.

11. The display apparatus according to claim 1, wherein the first portion and the second portion are substantially parallel.

* * * * *